US009786990B2

(12) United States Patent
Platt

(10) Patent No.: US 9,786,990 B2
(45) Date of Patent: Oct. 10, 2017

(54) INTEGRATED MULTIBAND ANTENNA

(71) Applicant: R.A. Miller Industries, Inc., Grand Haven, MI (US)

(72) Inventor: John Jeremy Churchill Platt, Grand Haven, MI (US)

(73) Assignee: R.A. Miller Industries, Inc., Grand Haven, MI (US)

( * ) Notice: Subject to any disclaimer, the term of this patent is extended or adjusted under 35 U.S.C. 154(b) by 89 days.

(21) Appl. No.: 14/628,704

(22) Filed: Feb. 23, 2015

(65) Prior Publication Data

US 2015/0244075 A1 Aug. 27, 2015

Related U.S. Application Data

(60) Provisional application No. 61/943,634, filed on Feb. 24, 2014.

(51) Int. Cl.

| | |
|---|---|
| ***H01Q 9/22*** | (2006.01) |
| ***H01Q 1/38*** | (2006.01) |
| ***H01Q 9/18*** | (2006.01) |
| ***H01Q 21/30*** | (2006.01) |
| ***H01Q 5/50*** | (2015.01) |
| ***H01Q 5/335*** | (2015.01) |
| ***H01Q 1/27*** | (2006.01) |
| ***H01Q 5/321*** | (2015.01) |

(52) U.S. Cl.

CPC ..... *H01Q 9/22* (2013.01); *H01Q 1/27* (2013.01); *H01Q 1/38* (2013.01); *H01Q 5/321* (2015.01); *H01Q 5/335* (2015.01); *H01Q 5/50* (2015.01); *H01Q 9/18* (2013.01); *H01Q 21/30* (2013.01)

(58) Field of Classification Search

CPC H01Q 9/22; H01Q 5/335; H01Q 5/40; H01Q 21/30; H01Q 1/273; H01Q 5/00

USPC ..... 343/792

See application file for complete search history.

(56) References Cited

U.S. PATENT DOCUMENTS

| | | | | |
|---|---|---|---|---|
| 2,987,721 | A * | 6/1961 | Edwards | H01Q 9/40 343/725 |
| 5,572,227 | A * | 11/1996 | Pal | H01Q 5/40 343/727 |
| 7,053,851 | B1 | 5/2006 | Bogdans | |
| 2004/0017323 | A1* | 1/2004 | Martiskainen | H01Q 1/242 343/792 |
| 2004/0145522 | A1* | 7/2004 | Wang | H01Q 1/38 343/700 MS |
| 2005/0062659 | A1* | 3/2005 | Packer | H01Q 1/084 343/718 |
| 2008/0074340 | A1* | 3/2008 | Song | H01Q 1/38 343/816 |
| 2008/0143629 | A1* | 6/2008 | Apostolos | H01Q 1/3275 343/793 |

(Continued)

FOREIGN PATENT DOCUMENTS

| | | | |
|---|---|---|---|
| EP | 1978594 | A1 | 10/2008 |
| EP | 2495807 | A1 | 9/2012 |

(Continued)

*Primary Examiner* — Dameon E Levi
*Assistant Examiner* — David Lotter
(74) *Attorney, Agent, or Firm* — McGarry Bair PC

(57) ABSTRACT

An end fed dipole antenna on a circuit board configured to be a multiband, portable radio antenna has, among other features, an integrated diplexer for operating the antenna in multiple frequency bands.

8 Claims, 9 Drawing Sheets

(56) References Cited

U.S. PATENT DOCUMENTS

| | | | | |
|---|---|---|---|---|
| 2008/0158083 | A1* | 7/2008 | Apostolos | H01Q 19/30 343/791 |
| 2009/0051609 | A1* | 2/2009 | Packer | H01Q 5/00 343/718 |
| 2010/0283699 | A1* | 11/2010 | Apostolos | H01Q 1/3275 343/792 |
| 2012/0268337 | A1* | 10/2012 | Platt | H01Q 1/38 343/795 |
| 2013/0009832 | A1* | 1/2013 | Apostolos | H01Q 1/273 343/730 |

FOREIGN PATENT DOCUMENTS

| | | | |
|---|---|---|---|
| EP | 2515375 | A2 | 10/2012 |
| WO | 2014/025263 | A1 | 2/2014 |

* cited by examiner

INTEGRATED MULTIBAND ANTENNA

CROSS-REFERENCE TO RELATED APPLICATION

This application claims the benefit of U.S. application No. 61/943,634 filed Feb. 24, 2014.

BACKGROUND OF THE INVENTION

Antennas implemented on circuit boards can have various advantages such as a small form factor, low cost of manufacture, and a compact and robust housing. A dipole antenna in particular can be implemented on a circuit board using standard methods of manufacturing circuit boards. Therefore circuit board manufacturing methodologies provide design flexibility in terms of designs that can be implemented on both sides of the printed circuit board. Furthermore, the mass manufacturing techniques employed in circuit board manufacturing can lead to low cost and highly reliable antennas on a rigid substrate. In such antenna designs, many of the elements of the antenna can be implemented on the printed circuit board or as discrete parts, including the dipole of the antenna, as well as, feed points, transmission lines, and external connections.

BRIEF DESCRIPTION OF THE INVENTION

In one aspect, the present invention is an integrated multiband antenna characterized by one or more end-fed dipoles on a circuit board inside a cylindrical radome configured to resonate in at least two distinct bands. A diplexer circuit inside the cylindrical radome combines the bands into a single transmission feed, and a single connector connects to the single transmission feed.

DETAILED DESCRIPTION OF THE DRAWINGS

Figure 1:
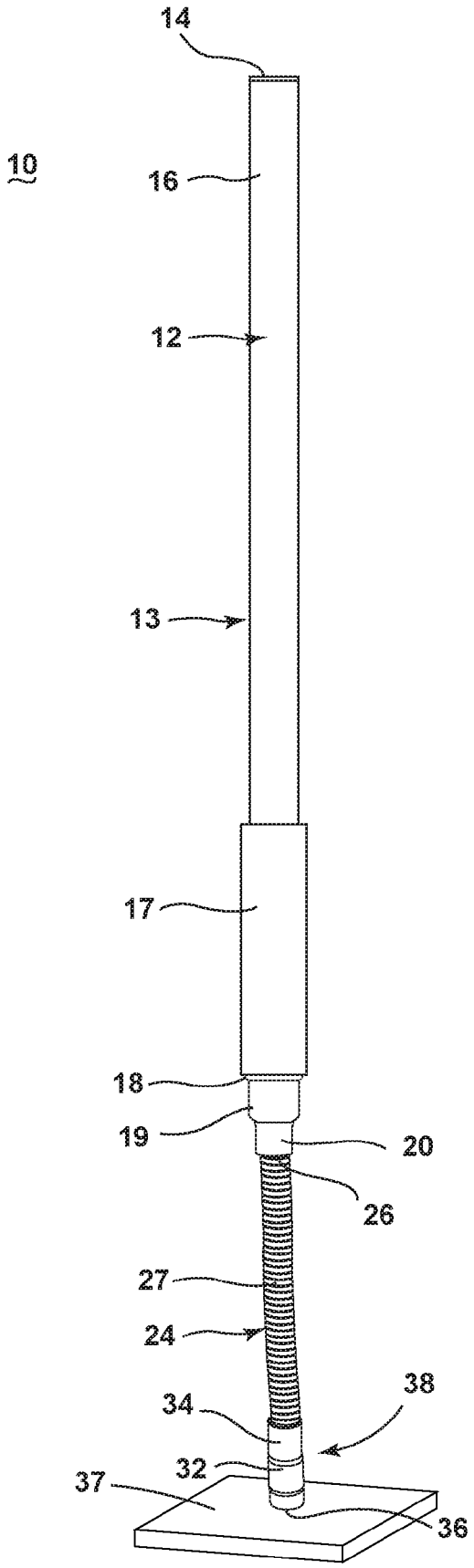
FIG. 1 is an elevation view of a schematic diagram of an integrated multiband dipole antenna according to one embodiment of the current invention with a gooseneck cable attached thereto.

Referring now to FIG. 1, the external features of the end fed dipole antenna with a gooseneck cable 10 are discussed. The end fed dipole antenna 12 comprises a radome 13 with an end wall 14, sidewall 16, a tapered portion 18, and an end connector 20. The radome 13 is generally a length, girth, and volume sufficient to house a dipole antenna board within. The radome 13 may be cylindrical in shape with cylindrical sidewalls 16 and circular end wall 14. Alternatively, the radome 13 can be any other suitable shape including a rectangular box with a rectangular end wall 14. The radome 13 may be formed by any known method including, but not limited to injection molding and extruding. The materials for forming the radome 13 may be any suitable material that will not act as a Faraday cage for the antenna board and components contained therein, including, but not limited to thermoplastic materials. The exact shape and material of construct of the radome 13 does not detract from the embodiments of the inventions described herein.

A radome tube support 17 having cylindrical sidewalls with a larger diameter than sidewall 16 may partially enclose the radome 13. A tapered portion 18 is provided as a transition of the radome support tube 17 and a shielding ferrule 19. The shielding ferrule 19 is generally a length, girth and volume sufficient to house additional electronic components within. The shielding ferrule 19 comprises a circular clamp (not shown) to attach to an end connector 20.

The end connector 20 can have a mechanical connector mechanism (not shown) to connect the end fed dipole antenna 12 to a cable 24. The cable 24 comprises a cable to antenna connector 26, a conductive cord portion 27 and a cable end connector 38. The cable end connector 38 comprises a cable end connector mechanical connection 32, a cable end connector tapered portion 34, and a cable end connector electrical interface 36. The cable 24 can be a gooseneck cable where the conductive cord portion 27 can be mechanically bent in various directions. The cable to antenna connector 26 and the cable end connector electrical interface 36 can be of any known type of radio frequency (RF) coaxial connector including, but not limited to, Threaded Neill-Concelman (TNC), SubMiniature version A (SMA) and Bayonet Neill-Concelman connector (BNC) (also N-type and/or Non-Rotating N-type are being implemented).

The embodiments shown and the dimensions, parameters, and values of components, traces, and circuit boards are directed to a multiband dipole antenna with a first frequency range between 225 and 450 MHz in the UHF band and a second frequency range between 1200 MHz and 2000 MHz in the L-band. The invention disclosed herein is not limited to these frequency bands and can be directed to any frequency band. By way of example, additional embodiments of the present invention are directed to a triband antenna with a third frequency range between 30 MHz and 88 MHz in the VHF band. As such the dimensions, parameters, and values of any elements discussed herein are not limitations to the invention, but merely examples of one known implementation of the invention in a particular target frequency band.

Figure 2:
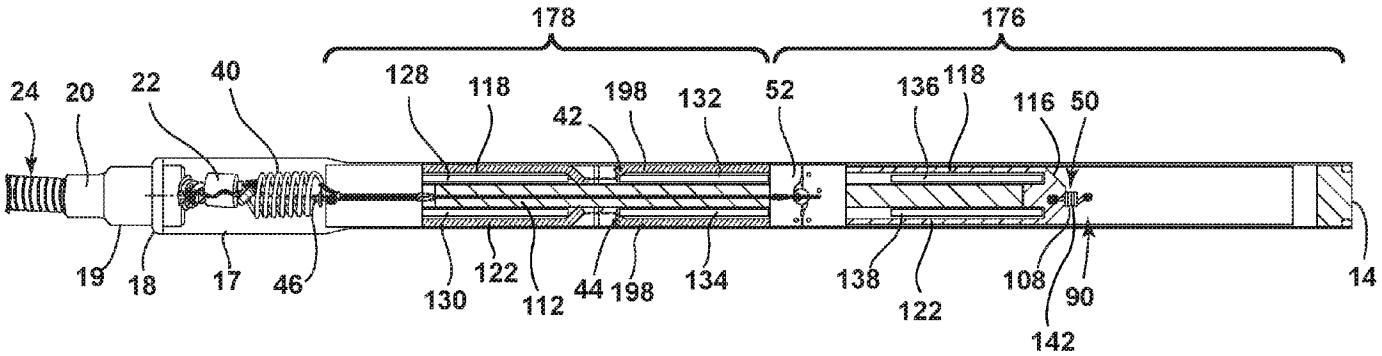
FIG. 2 is a cross sectional view from one side of the integrated multiband dipole antenna of FIG. 1.
Figure 3:
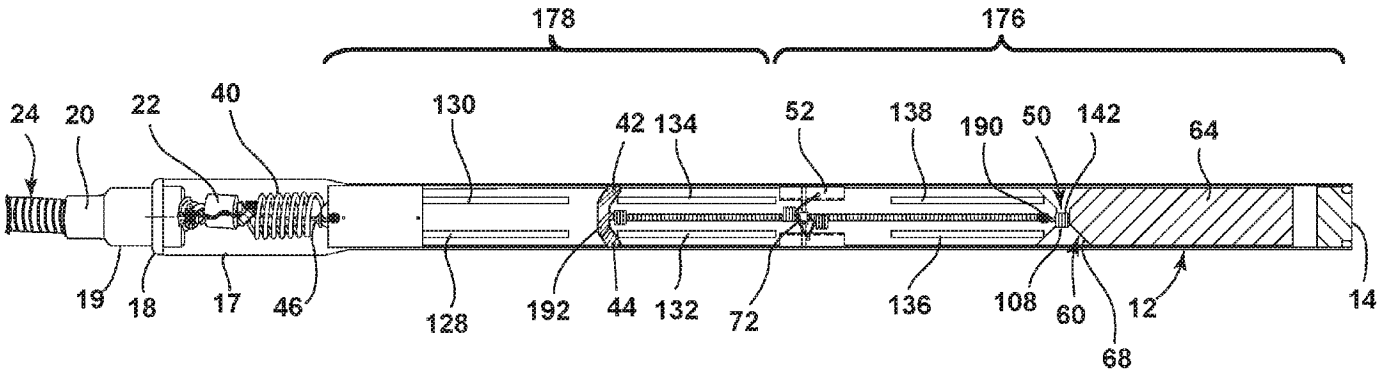
FIG. 3 is a cross sectional view from another side of the integrated multiband dipole antenna of FIG. 1.

Referring now to FIGS. 2 and 3, dipole antenna board 50 contained within the radome 13 is discussed. The dipole antenna board 50 comprises a circuit board 52 with various components and electrical traces disposed thereon and housed within the radome 13 to form the end fed dipole antenna 12. The circuit board 52 can be any known insulative material used for such applications including, but not limited to FR-4.

FIGS. 2 and 3 illustrate a dipole antenna board 50 having, respectively, a first side 90 and a second side 60. The dipole antenna board 50 comprises a circuit board 52 having an upper, or first, L-band dipole 176 and a lower, or second, L-band dipole 178, illustrated in FIG. 3.

The first embodiment dipole antenna board 50 comprises a first side conductive element 64 disposed on the second side 60 of the circuit board 52, having a tapered portion 68 electrically coupled with the first side 90 by a through-hole via 108. The through-hole via 108 is made electrically conductive by methods known in the field of circuit board manufacturing, such as by an etching process, silk screening, sputtering, electroless plating, electroplating, and the like. In a preferred embodiment, an inductive circuit element 142 is mounted in the through-hole via 108 for purposes of connection, providing electrical matching. The through-hole via 108 can have a sufficient diameter, such that the aspect ratio of the through-hole via 108 is low enough to allow for reliable deposition of metal within the through-hole via 108.

The conductive element 64 is electrically coupled with a microstrip transmission line 72 disposed on the circuit board 52. The microstrip transmission line 72 is coupled with the conductive element 64 at a feed point 190 located at the through-hole via 108 on one end and an open slot trap connector 192 on the other end. The feed point 190 is attached to the tapered end 68 of the conductive element 64 by solder or any other known method of attaching discrete components on circuit boards. The solder can be of any known type including, but not limited to, standard lead-tin (Pb—Sn) alloy or tin-silver-copper (SAC) alloy. The solder may be applied to the circuit board 52 by any known method including, but not limited to, screen printing solder paste or high volume wave soldering techniques.

The upper dipole feed point 190 is shown connected to the conductive element 64 with an inductor 142, as in the first embodiment, although a capacitor may also be used to facilitate balancing of the dipoles. Alternatively, the electrical coupling between the feed point 190 and the conductive element 64 can be a resistor, a conductive trace connection (or a trace, or transmission line), a capacitor, an inductor or combination thereof. The connection element and its resulting impedance can be chosen to tune the dipole antenna or to provide a filtering mechanism for the signals provided to or coming from the dipole antenna. The lower dipole feed point 192 is mechanically and electrically connected to the lower dipole upper element traces 198 by way of through-hole vias 42, 44, which are identical to the through-hole via 108 on one end, and microstrip 72 via an optional inductor or other electrical matching on the other side of the though-hole vias.

The L-band dipoles 176, 178 can comprise a first lower radiating element trace 118 and a second lower radiating element trace 122 that each run along the edges on the first side 90 of the circuit board 52, and a center trace element 112 that runs along the length, extending through the lower L-band dipoles 176, to the feed point of upper L-Band dipole 178, near the middle of the circuit board 52. The traces 118, 122, 112 extend from a tapered element 116 of the upper L-band dipole 176. The traces 118, 122, 112 disposed on the first side 90 are physically isolated from the microstrip transmission line 72 disposed on the second side 60.

The traces 118, 122, and 112 are separated from each other by dielectric tuning slots 128, 130, 132, 134, 136, 138 therebetween. The length of the dielectric tuning slots 128, 130, 132, 134, 136, 138 may be selected to optimize the performance of the antenna at various L-band frequencies. Generally, lengthening the dielectric tuning slots improves the L-band dipole's electrical response to high L-band frequencies. Conversely, shortening the dielectric tuning slots improves the L-band dipole's response to lower L-band frequencies. Additionally, translating the position of the slots along the length of the L-band dipole elements may adjust the electrical impedance and consequently the efficiency of the antenna, typically measured by the voltage standing wave ratio (VSWR). By controlling the size and position of the dielectric tuning slots, overall antenna performance may be designed and customized by controlling characteristics such as VSWR to improve the gain of the L-band dipole antenna elements in desirable areas of the radiation pattern at particular frequencies.

The L-band dipole antenna board 50 may preferably be housed in a second inner radome (not shown). The second inner radome is generally a length, girth, and volume sufficient to house the L-band dipole antenna board 50 within and be located inside the first radome 13. The radome 13 may be cylindrical in shape. In one embodiment, the second inner radome may have a diameter of 0.565". To enhance the performance of the antenna in the L-band spectrum by increasing the operable frequency range, the second inner radome may comprise copper tape disposed in strips in a configuration known as an open sleeve dipole (the sleeves are conductive elements, the radome is the dielectric that supports or suspends the open/closed sleeves) or in a tubular configuration known as a closed sleeve.

The center trace element 112 is electrically coupled to a section of low loss semi-rigid cable 40 which can preferably be disposed on center trace element 112 via solder all the way up to microstrip 72 where the center conductor of 40 can be connected to microstrip 72 by a through-hole via 42, 44. The coil form portion of low loss semi-rigid cable 40 may be of a material and configuration to form a high impedance cable choke (a/k/a an inductor). The semi-rigid coaxial cable shield may preferably be made of copper to provide beneficial effects to the antenna 10 such as acting as a heat sink for electrical elements such as the transformer 22 and diplexer 144, most clearly seen in FIG. 5 at 144, and aiding in the power handling of the antenna 10. In a first embodiment, the low loss semi-rigid cable 40 comprises an air core helical coil with an interior diameter commensurate to the diameter of the second inner radome. For example, a low loss semi-rigid cable 40 comprising an air core helical coil and a second inner radome may both have a diameter of 0.565". Alternatively, the helical coil of semi-rigid cable 40 may also be wound on a ferrite rod or wrapped on a torroid.

According to an embodiment of the invention, the center trace element 112 is electrically coupled to a conductor (bus wire, or connector wire, etc.) 46. The conductor 46 may preferably be fed through the helical coil of semi-rigid cable 40. The helical coil of low loss semi-rigid cable 40 forms a high impedance inductor at UHF frequencies to allow the UHF feed point to be fed across or inside the semi-rigid helical coil of semi-rigid cable 40 with the conductor 46, while passing the L-band signal between the dipole antenna board 50 and the diplexer, most clearly seen in FIG. 5 at 144. The other end of conductor 46 is connected to a transformer 22 (optional). The diplexer assembly comprises a diplexer in the form of a circuit board used to mechanically and electrically connect the (optional) transformer to the cable 40. The diplexer board assembly is soldered to a brass ferrule 19 that is crimped to the gooseneck cable 24. Another ferrule is threaded over the first ferrule, which forms an RF shield for the diplexer. The other end of the diplexer board assembly is grounded to the second ferrule via a tinned braid and solder. The outside diameter of the second ferrule also supports the radome 13. This effectively shields the diplexer 144.

The shield of the semi-rigid cable 40 has the same electrical potential as the diplexer 144, the ferrule 19, and the gooseneck cable 24. Several additional electrical components, such as capacitors and inductors, may be disposed on the dipole antenna circuit board 52, the diplexer 144, the transformer 22 and the intervening connections thereto. To render the impedance of the L-band dipole antenna circuit board 52 compatible with UHF band signals while not affecting the integrity of the antenna circuit operating at L-band, the additional electrical components may be needed to isolate or connect various traces such as 72, 112, 118, 122 on the dipole circuit board 52.

As per an embodiment of the invention, the L-band circuit board 52 has relatively high impedance at the UHF frequencies when referenced to the impedance of the gooseneck cable 24, the diplexer 144 and the ferrule 19. Additionally, the L-band circuit board's electrical characteristics, such as impedance, enable the L-band circuit board 52, specifically the combination of the upper L-band dipole 176 and the lower, L-band dipole 178, to act as an upper element of a collinear dipole in the UHF band of the spectrum. The gooseneck cable 24 and the radio chassis 137 connected to the cable end connector electrical interface 36 form the lower element of the dipole in the UHF band. In one embodiment of the invention, as shown in FIGS. 2 and 3, the impedance, formed across each end of the helical coil of semi-rigid coaxial cable 40, is about 900 Ohms at resonance; that is, at frequencies where the impedance is purely resistive.

As described above, the conductor 46 is fed through the helical coil of semi-rigid coaxial cable 40. The conductor 46 is a connector that connects the L-band circuit board 52 to the output of (high impedance port) transformer 22. As embodied in FIGS. 2 and 3, the transformer 22 may be a 4:1 unun impedance transformer. An unun impedance transformer is an isolation filter that may be used to match the impedance of unbalanced antenna elements to unbalanced feed lines. As embodied in the present invention, the antenna elements are unbalanced connections. (The elements are unbalanced as referenced to the diplexer board potential but not all are coaxial as the term usually refers to transmission line). As embodied in FIGS. 2 and 3, the (optional) transformer 22 along with additional matching components, transforms the impedance in the UHF band down to approximately 50 Ohms. In a preferred embodiment of the present invention, the transformer 22 may be formed on a ferrite bead or toroid to reduce size, increase bandwidth or power handling. Additionally, in a space-saving design, the transformer 22 may be constructed to slide over straight sections of the semi-rigid cable 40 or the second cable 46. While the transformer 22 may be constructed with electrical components capable of handling a range of power, in a preferred embodiment, the transformer 22 is capable of handling 20 watts.

Figure 4:
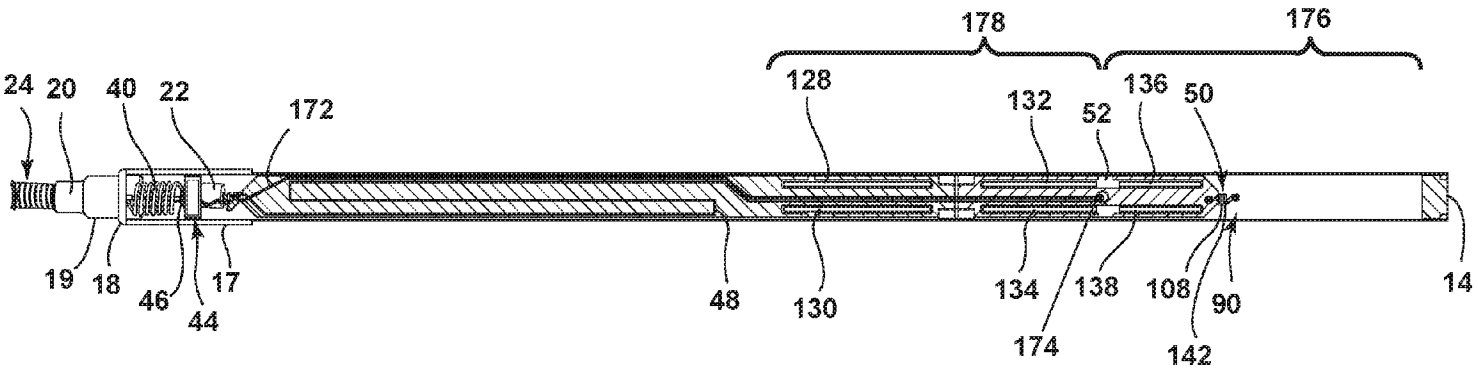
FIG. 4 is a cross sectional view from one side of a second embodiment of the integrated multiband dipole antenna of FIG. 1.

Referring now to FIG. 4, a second embodiment of the multiband dipole antenna 10 of FIG. 1 is shown, presenting an alternative antenna feed from the L-band dipole circuit board 52 to the transformer 22 and diplexer 144. Along with an additional straight length of cable 172 from the L-band circuit board 52, a hair-pin feed 48 may be placed next to the straight length of cable 172 from the L-band circuit board 52. The additional straight length of cable 172 and the hair-pin feed 48 may be disposed as traces on the dipole antenna board 50 or as additional conductors. At 174, the hair-pin feed 48 is connected and grounded to the L-band cable 172. The other end of the hair-pin feed 48 has high impedance at the UHF band and may be fed with a transformer 22 such as a 4:1 unun impedance transformer as described above. The L-band and UHF signals may then be combined in the diplexer 144. The combined L-band and UHF signals may be directed to the helical coil of coaxial cable 40. In this configuration, the helical coil of coaxial cable 40 may act as a high impedance choke, defining the UHF dipole as the combination of the upper L-band dipole 176, the lower L-band dipole 178, the hair-pin feed 48 and the straight length of cable 172, the transformer 22 and the diplexer 144. To act as a high impedance choke, the helical coil of coaxial cable 40 may be wrapped around a suitable material such as a dielectric, a toroid or ferrite rod. Alternatively, ferrite beads may be disposed on the helical coil of coaxial cable 40. In this configuration the diplexer may need to be shielded (not shown).

Figure 5:
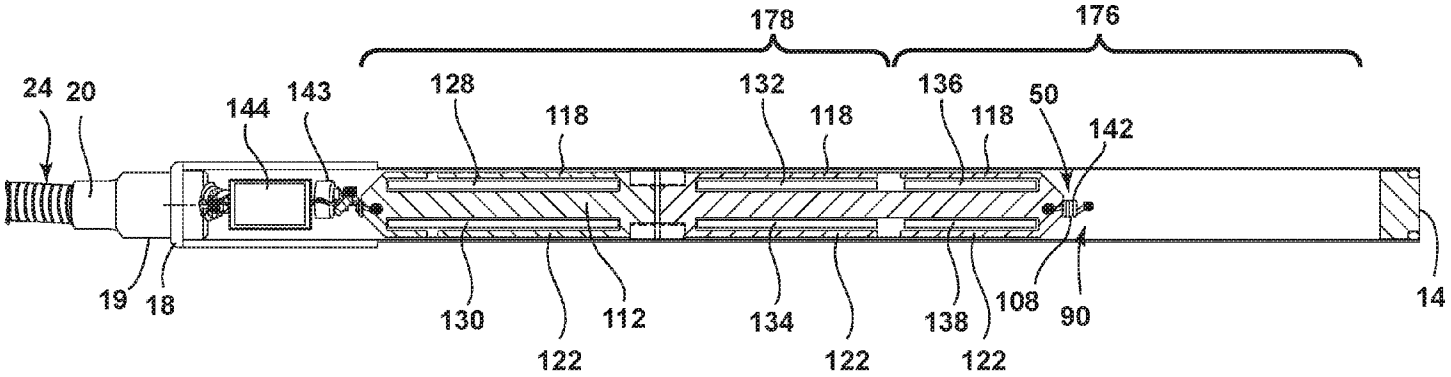
FIG. 5 is a cross sectional view from one side of a third embodiment of the integrated multiband dipole antenna of FIG. 1.

Referring now to FIG. 5, in an alternative embodiment, the L-band circuit board 52 may be fed using a balun assembly 143 similar to the unun discussed above. The balun assembly 143 is essentially a 4:1 impedance transformer that matches impedance at the antenna terminals to the unbalanced transmission line. Using the balun assembly 143 with an integrated L-band coaxial cable where the L-band cable is wrapped around the toroid of the balun transformer, the high impedance point is integrated into the balun assembly 143.

Figure 6A:
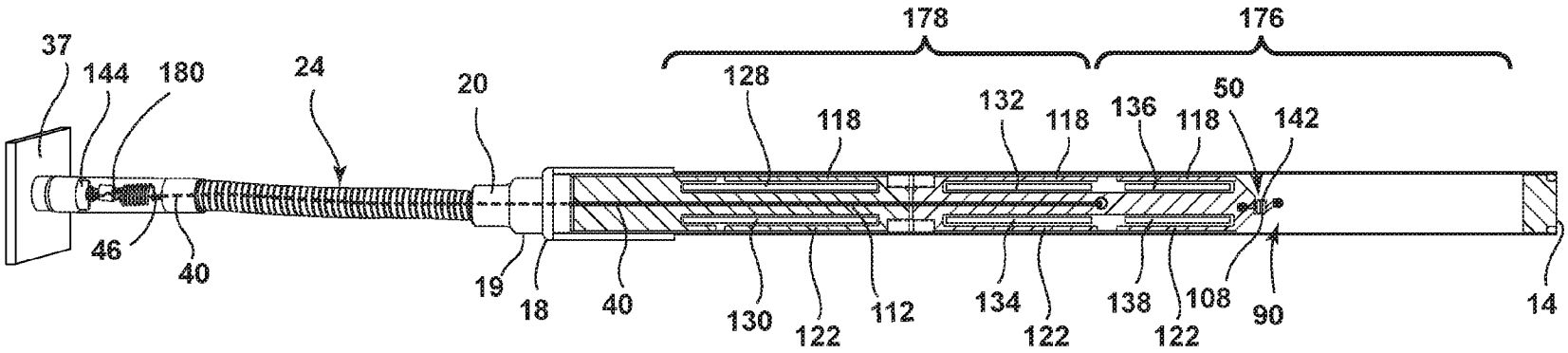
FIGS. 6A and 6B are cross sectionals view from one side of another embodiment of the integrated multiband dipole antenna of FIG. 1.
Figure 6B:
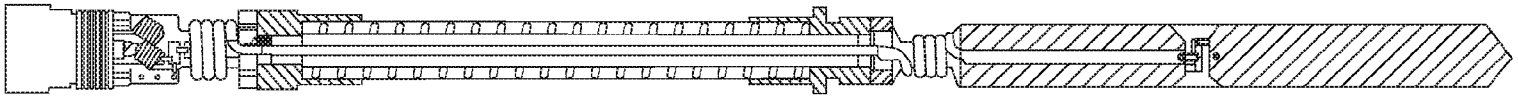

Referring now to FIG. 6A, an additional embodiment of the multiband antenna is shown where the diplexer 144 circuit board is connected to the gooseneck cable 24 at the end of the antenna furthest from the dipole circuit board 50. The high impedance choke 40 formed from RG-316 double shield transmission line 40, is connected to the gooseneck end of high impedance choke 40, along with conductor 46. The shield of the other end of high impedance choke 40 remains directly connected to the diplexer 144 circuit board at the same potential as the diplexer and connector 36 while the center conductor of high impedance choke 40 connects to the L-Band output of the diplexer. The other end of conductor 46 is connected to the transformer 22 (or 180) and the other end of the transformer 22 (or 180) is connected to the UHF output of the diplexer. In some configurations the transformer 22 (or 180) may not be needed in which case the conductor 46 connects to the UHF output of the diplexer 144 via some additional matching contained on the diplexer PCB. This effectively moves the diplexer and UHF feedpoint to the base of the antenna instead of the top end of the gooseneck cable. In this configuration, the dimensions of the antenna may be sized for hand-held radio applications and electrically be an end feed dipole or quarter wave monopole referenced to the radio chassis 137. The base end is contained within a dielectric sleeve and potted with hardening epoxy as is typically done in the art of hand held antennas.

Figure 7A:
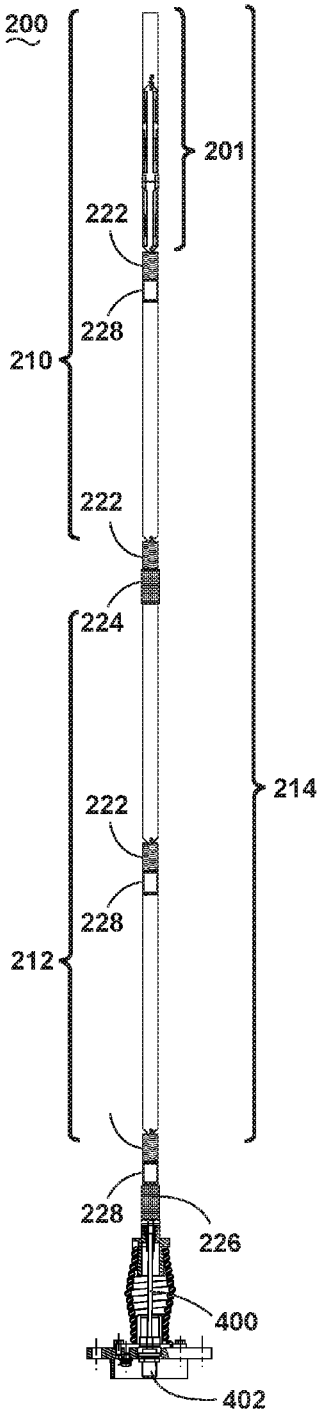
FIGS. 7A, 7B, and 7C are cutaway elevation views of a schematic diagram of an integrated triband dipole antenna according to several embodiments of the current invention.
Figure 7B:
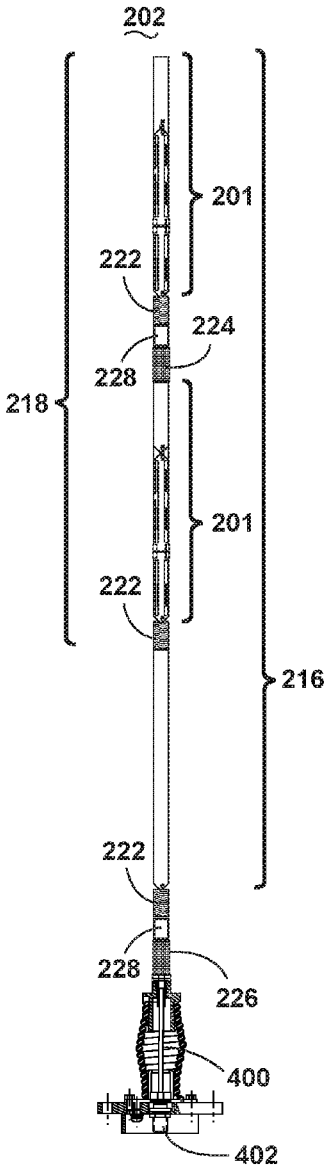
Figure 7C:
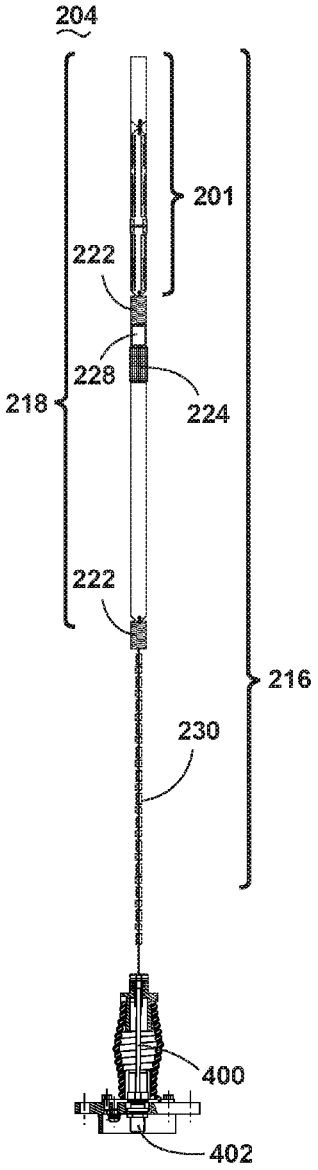

Referring now to FIGS. 7A-C, the antenna elements of the current invention are combined to form a dual-band (FIG. 7C) or tri-band antenna (FIGS. 7A and 7B) to be used in various applications such as a HMMV Vehicular or Mobile MULE Vehicle (Multifunctional Utility/Logistics Equipment vehicle). Typically one or more (but not limited to)

L-band dipole circuit boards 201 are placed at the top with diplexer and cable choke elements to add UHF band of operation to the antennas 200, 202, 204. In FIG. 7A, the antenna 200 may have one L-band circuit board 201 two UHF dipole elements 210, 212 and the combination of the L-Band PCB 201, the two UHF dipole elements 210, 212 form a VHF monopole or dipole antenna element 214. To facilitate operation in the UHF and VHF bands, high impedance chokes 222 and impedance matching elements 228 are interspersed between the dipole antenna circuit boards. Additionally, a diplexer element 224 may be disposed at the intersection of the UHF dipole elements (actually at junction of the transmission lines that would feed the dipoles (L-Band and UHF) 210, 212 for combining the UHF and L-band signals. An additional diplexer 226 may be used to combine the VHF band signal with the combined UHF and L-band signal. FIG. 7B shows an alternative embodiment of the triband antenna of FIG. 7A with two L-Band PCBs, one UHF dipole for operation in the L-band, UHF and VHF spectra with a VHF end-fed dipole or monopole element 216 resulting from the L-Band and UHF dipoles. FIG. 7C shows another alternative embodiment of a dual-band antenna with a L-Band dipole circuit board and single UHF dipole elements 218 where the lower half of the antenna is fed with coax cable having ferrite beads 230 disposed there on. This in no way limits the number of possible combinations of antenna elements or bands. Such an antenna could have an L-Band antenna and 2 UHF dipoles, or 2 L-band elements and a single UHF dipole without a diplexer, or 2 UHF dipoles and a VHF dipole with a diplexer etc.

Figure 8:
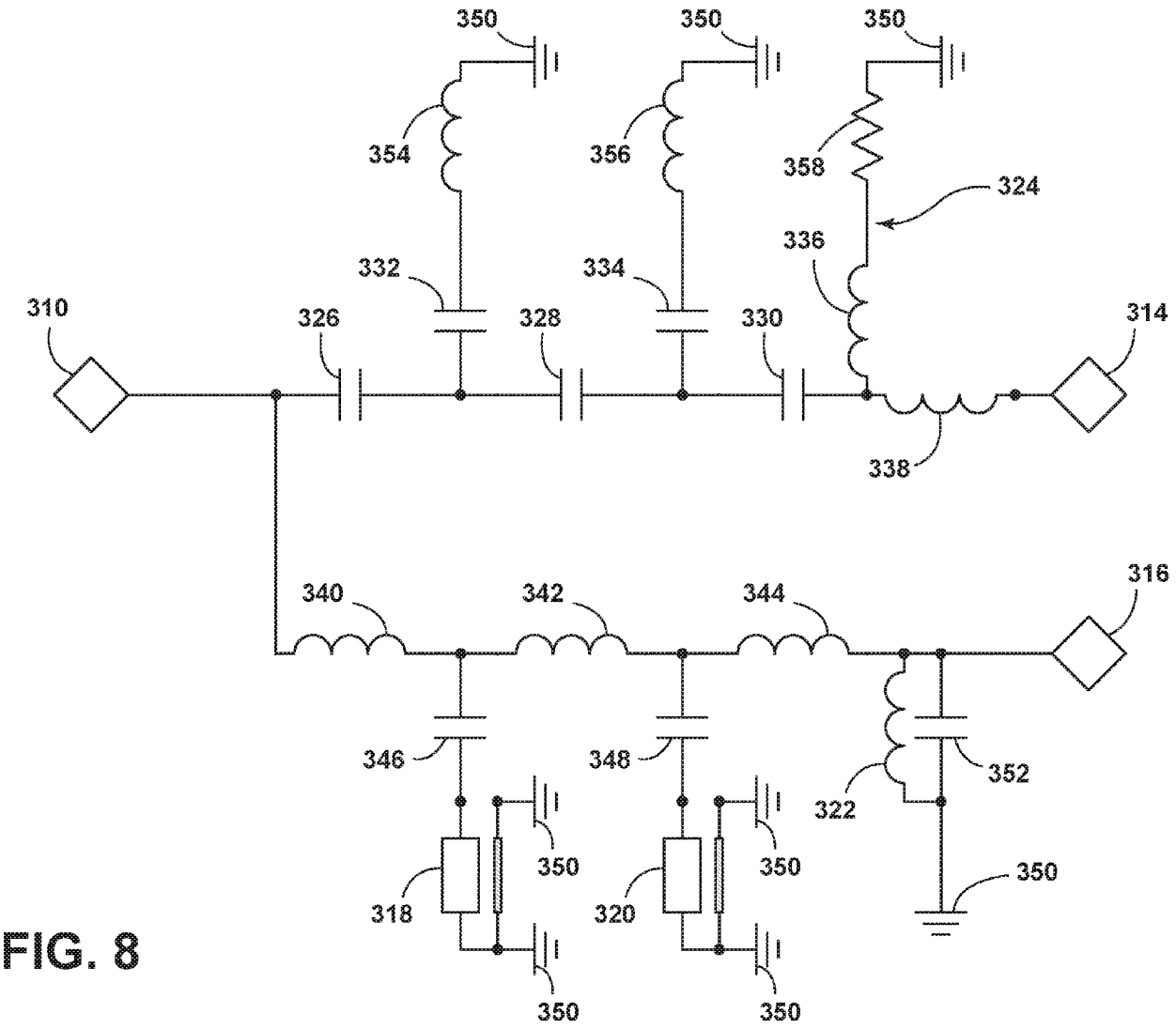
FIG. 8 is an electrical schematic diagram of the diplexer component of the integrated multiband dipole antenna according to an embodiment of the invention.

FIG. 8 is an electrical schematic diagram of the diplexer component of the multiband dipole antenna according to an embodiment of the invention. The diplexer assembly comprises a diplexer in the form of a circuit board used to mechanically and electrically connect an (optional) impedance transformer to a conductor such as a cable to combine multiple signals. For the present invention, the diplexer is primarily directed at combining an L-band signal at 314 and UHF band signals from an impedance matching transformer at 316. The combined L-band and UHF band signal is fed to a common point at 310.

Figure 9:
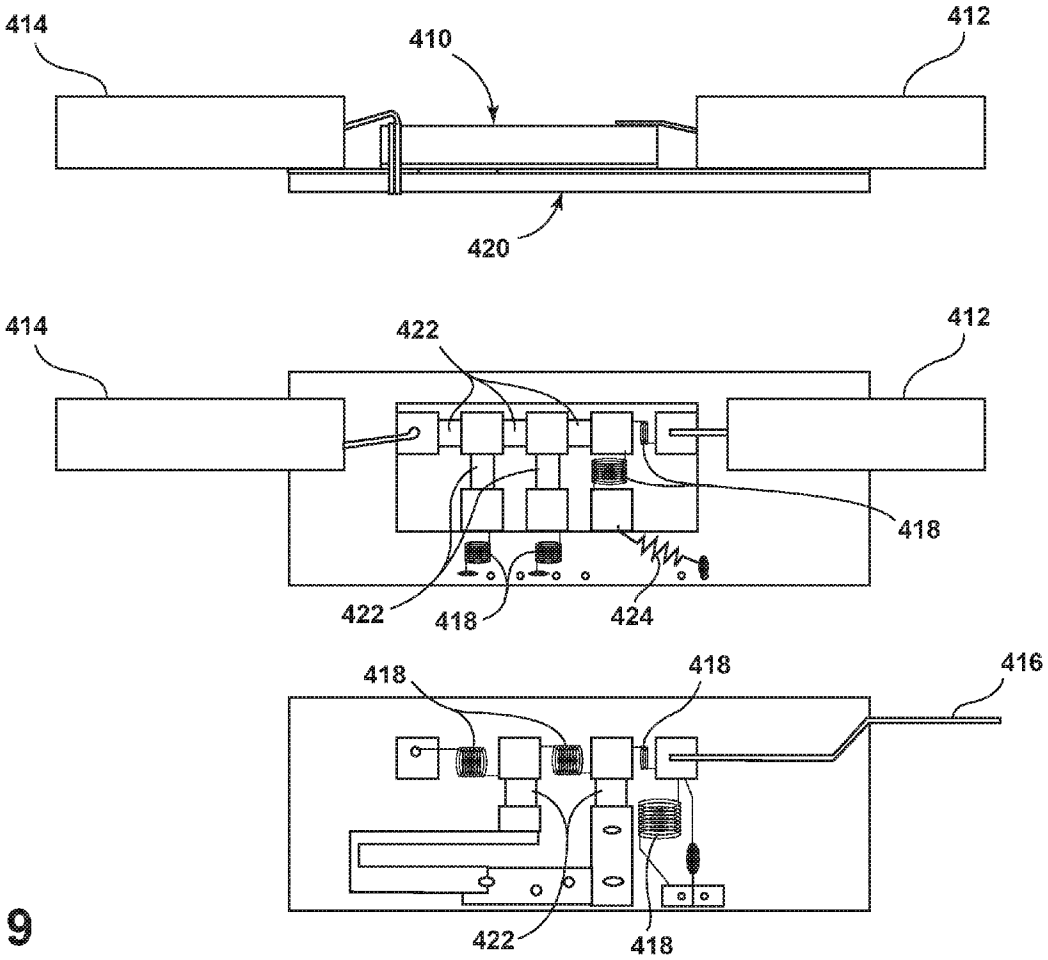
FIG. 9 is a schematic diagram of the circuit board layout of the diplexer component of FIG. 8 according to an embodiment of the current invention.

Referring now to FIG. 9, the diplexer consists of two diplexer circuit boards 410, 420. A first leg or filter of the diplexer is disposed on the first circuit board 410 and the second leg or filter of the diplexer is disposed on the second circuit board 420. The diplexer circuit boards 410, 420 can be any known insulative material used for such applications including, but not limited to ceramic and FR-4. Preferably, the first circuit board 410 is formed of ceramic for low-loss L-band performance while the second circuit board 420 may be formed of FR4. A copper plate 430 is disposed between the two diplexer circuit boards 410, 420 to form a ground plane. The two legs are connected together by a through-hole via 432 that feeds the combined L-band and UHF band signals 310 to the coaxial cable 414. The L-band signal 314 is fed to or from an L-band coaxial 412 while the UHF signal 316 is preferably connected to a 4:1 impedance matching transformer 416.

Referring to FIGS. 8 and 9, the diplexer circuitry may include capacitors, generalized in FIG. 9 at 422, and inductors, generalized in FIG. 9 at 418 mounted to the printed circuit boards 410, 420 and electrically interconnected to form at least two band-pass filters. As shown in FIGS. 8 and 9, the pass-bands may be in the L-band and UHF regions of the radio spectrum. The diplexer circuit boards 410, 420 may have additional components for impedance matching as well as a UHF neutralization circuit 324 formed of a neutralizing resistor most clearly seen in FIG. 8 as 358 connected in series to a high impedance inductor 336 to reduce UHF signals in the L-band leg of the diplexer.

While the specific arrangement of capacitors, shown in FIG. 8 as 326, 328, 330, 332, 334, 346, 348,352, surface mount inductors 322, 338, 340, 342, 344, 354, 356, 358, microstrip inductors 318, 320 and ground-plate connections 350, the diplexer may combine the UHF and L-band signals for the desired multiband antenna operation. Other arrangements of electrical components are possible to affect a desired radio frequency signal combination. For example, the circuit elements may be selected and arranged to form pass-bands in other regions of the radio spectrum such as VHF. While the diplexer may be configured with electrical components capable of handling a range of power, in a preferred embodiment, the diplexer is capable of handling 20 watts. While the integration of a diplexer is known, a method to combine signals within the antenna, while being compact and efficient at handling power is needed in order to maintain the profile of the antenna, and combine the transmission lines of multiple antennas into at least one connector to attach to a radio. One connector is the preferred embodiment as most modern radios can encompass all frequency bands using only one connector.

Figure 10A:
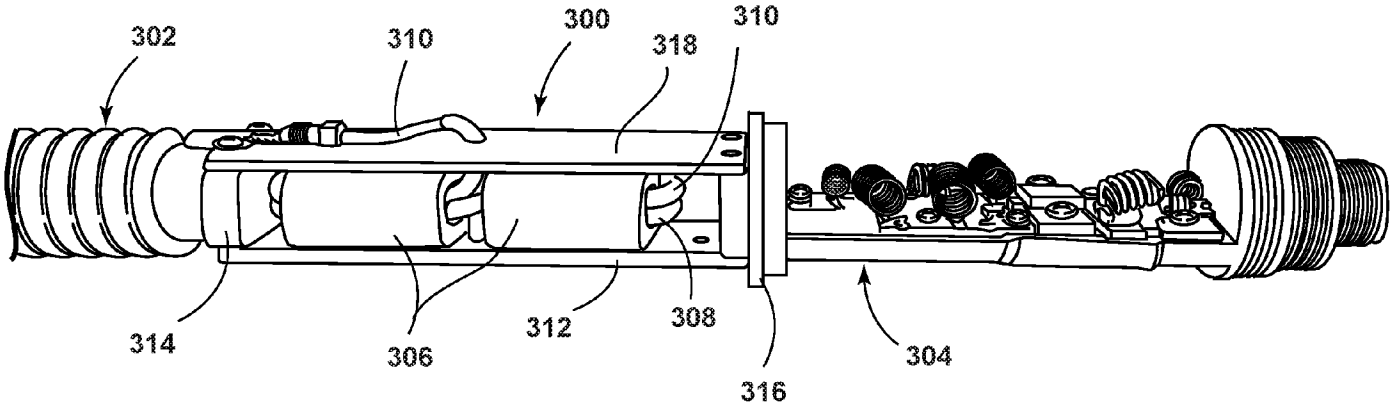
FIGS. 10A and 10B are cross sectional views from different sides of another embodiment of the integrated multiband dipole antenna of current invention.
Figure 10B:
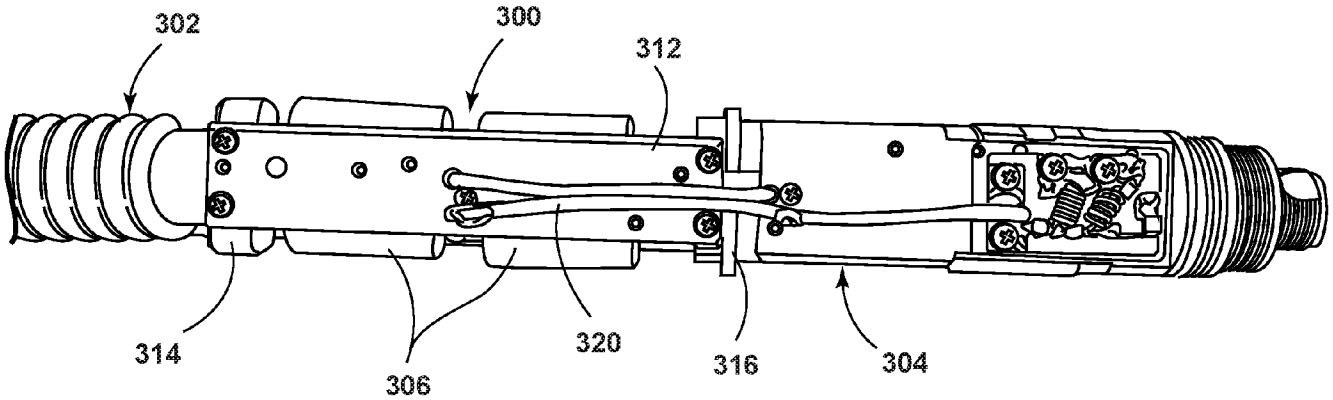

Referring now to FIGS. 10A and 10B, a further embodiment of a balun structure is shown, which structure is applicable to any of the foregoing embodiments. A balun 300 is disposed between a high impedance choke 302, similar to chokes 40, 222 above, and a matching or diplexer circuit 304, similar to diplexer 144 above. In order to better fit the balun 300 within cross sectional constraints of a portable or a whip antenna, the balun comprises one or more ferrite cores 306 shaped as flattened cylinders having a central bore 308, with a transmission line 310 coiled within the central bore 308. The ferrite cores 306 are mounted to a conductive plate 312 extending between a dielectric 314 of the choke 302 and a conductive spacer 316 of the diplexer circuit 304. A dielectric plate 318 sandwiches the ferrite cores 306 to the conductive plate 312. The transmission line 310 preferably extends from the choke 302 through the dielectric plate 318 to the balun 300, and leads 320 extend from the balun 300 through the conductive plate 312 to the diplexer circuit 304.

Figure 11B:
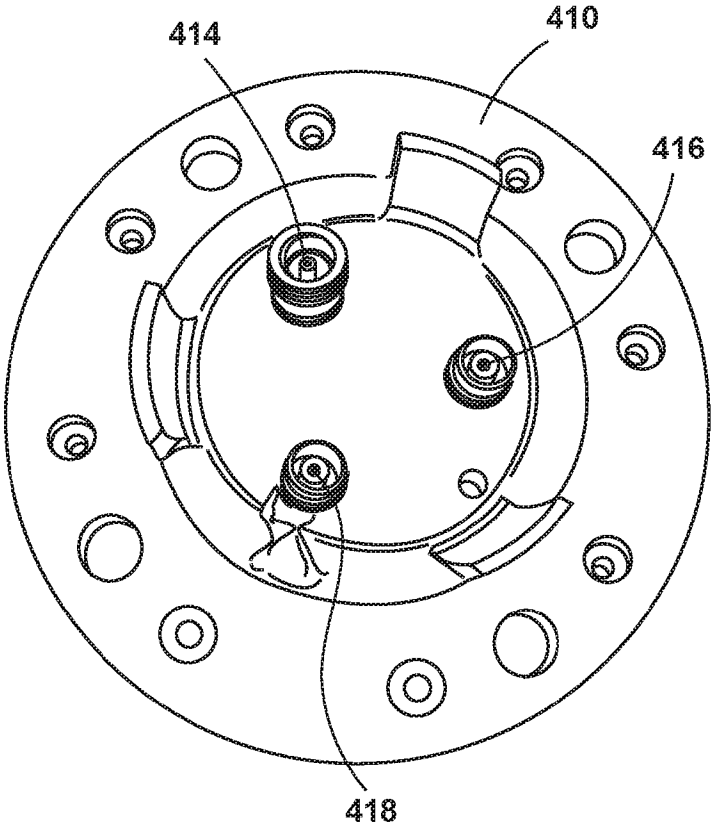
FIGS. 11A and 11B illustrate opposite sides of a connector adapter according to an aspect of the invention.
Figure 11A:
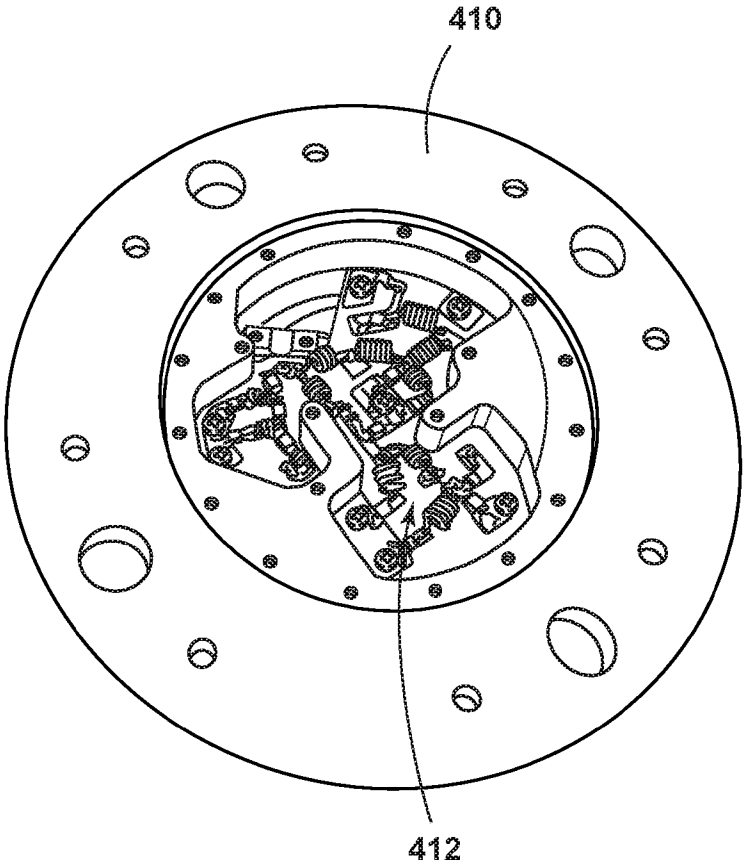

It will be apparent that the multiband output from all embodiments herein described is a single transmission feed 400 carrying a multiband signal to a single connector 402. A receiving device (not shown) capable of splitting the multiband signal into respective bands can be easily connected to the single connector 402. Where a receiving device is incapable of splitting the multiband signal into respective bands, various connector adapters can be supplied which are connectable to the single connector 402, but which split the multiband signal into two or more bands as needed for the receiving device. One embodiment of a connector adapter 410 is shown in FIGS. 11A and 11B. The connector adapter 410 carries a multiplexer circuit 412 adapted to separate the bands of the multiband signal, and direct each separate band to a different connector 414, 416, 418. Each connector 414, 416, 418 can be a specified adapter type depending on the connection to a receiver, e.g., RCA, coaxial, BNC, etc.

The foregoing disclosure sets forth an improved multiband antenna design. The antenna is not limited to manpack antennas and could be used for vehicular antennas, handheld antennas and field-erectable antennas, as well as antennas with multiple UHF dipoles, VHF and the like. Operations in additional bands could be added to any combination of the VHF/UHF/L-Band antenna in the same way that UHF has been added to the L-band antenna and VHF has been added to the UHF/L-band antenna as described above.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. An integrated multiband antenna characterized by:

at least one L-band end-fed dipole on a circuit board inside an upper end of a dielectric radome;

a center trace element extending along the length of the circuit board from a lower end to a feed point of the at least one L-band dipole and electrically coupled to a conductor;

a UHF dipole inside the dielectric radome and electrically coupled to the conductor;

a helical coil of semi-rigid coax coupled to the center trace element to form a high impedance inductor at UHF frequencies;

a diplexer circuit connected to the helical coil inside the dielectric radome to combine L-band and UHF signals into a single into a single cable; and a balun or a transformer within the radome that transforms impedances at VHF frequencies, wherein the single cable passes though the balun or transformer.

2. The integrated multiband antenna of claim 1 wherein the impedance of the circuit board is configured to enable the circuit board to act as an upper element of the UHF dipole.

3. The integrated multiband antenna of claim 2 further comprising a cable connected to the diplexer and a radio chassis connected to the cable wherein the cable and the radio chassis form a lower element of the UHF dipole.

4. The integrated multiband antenna of claim 1 wherein the at least one L-band end-fed dipole on the circuit board includes dielectric tuning slots.

5. The integrated multiband antenna of claim 1 configured as one of a hand-held antenna, a man-pack antenna, a vehicular antenna, or a linear envelope.

6. The integrated multiband antenna of claim 3 wherein the cable is a goose-neck cable.

7. The integrated multiband antenna of claim 1 further comprising a connector adapter carrying a multiplexer circuit configured to separate the bands in the integrated multiband antenna and direct each separate band to a different connector.

8. The integrated multiband antenna of claim 1 wherein an inner tube over the at least one L-band end-fed dipole on the circuit board includes conductive closed sleeves.

* * * * *